US009834346B1

(12) United States Patent
Ferraro

(10) Patent No.: US 9,834,346 B1
(45) Date of Patent: Dec. 5, 2017

(54) ADAPTABLE BOTTLE SEAL BREAKER CAP

(71) Applicant: Joseph Ferraro, Farmingdale, NY (US)

(72) Inventor: Joseph Ferraro, Farmingdale, NY (US)

( * ) Notice: Subject to any disclaimer, the term of this patent is extended or adjusted under 35 U.S.C. 154(b) by 0 days.

(21) Appl. No.: 14/868,112

(22) Filed: Sep. 28, 2015

(51) Int. Cl.

| | |
|---|---|
| ***B65D 51/24*** | (2006.01) |
| ***B65D 41/00*** | (2006.01) |
| ***B65D 43/00*** | (2006.01) |
| ***B65D 51/22*** | (2006.01) |
| ***B65D 39/00*** | (2006.01) |
| ***B65D 47/00*** | (2006.01) |
| ***B65D 51/00*** | (2006.01) |

(52) U.S. Cl.
CPC ..... *B65D 51/223* (2013.01); *B65D 51/224* (2013.01); *B65D 51/243* (2013.01)

(58) Field of Classification Search
CPC .... B65D 51/22; B65D 51/221; B65D 51/222; B65D 51/223; B65D 51/224; B65D 51/228; B65D 51/243
USPC ..... 220/278; 215/226, 303; 3/278
See application file for complete search history.

(56) References Cited

U.S. PATENT DOCUMENTS

| | | | | |
|---|---|---|---|---|
| 1,100,433 | A | 6/1914 | Johnson | |
| D55,395 | S | 6/1920 | O'Brien | |
| 1,703,759 | A | 2/1929 | Ament | |
| 2,414,420 | A * | 1/1947 | Sebell | B65D 55/12 215/230 |
| 2,702,652 | A | 2/1955 | Joyce | |
| 2,771,218 | A | 11/1956 | Henderson | |
| 2,828,890 | A | 4/1958 | Brownfield | |
| 2,857,068 | A | 10/1958 | Kraepelin | |
| D196,112 | S | 8/1963 | Esser | |
| 3,581,605 | A | 6/1971 | Taylor | |
| D250,168 | S | 11/1978 | Brandt | |
| 4,340,147 | A | 7/1982 | McIntosh | |
| 4,634,013 | A | 1/1987 | Bar-Kokhba | |
| 4,709,822 | A | 12/1987 | Vataru | |
| D310,969 | S | 10/1990 | Butler | |
| 5,090,582 | A | 2/1992 | Art | |
| RE33,886 | E | 4/1992 | Ullman | |
| 5,148,937 | A | 9/1992 | Huard | |
| 5,280,764 | A | 1/1994 | Levinrad | |
| 5,388,297 | A | 2/1995 | Ross | |
| 5,566,859 | A | 10/1996 | Willis | |
| 5,709,311 | A | 1/1998 | Butler | |
| 5,791,505 | A | 8/1998 | Gilliland | |
| D405,371 | S | 2/1999 | Herr | |
| 5,865,330 | A | 2/1999 | Buono | |
| 6,024,234 | A | 2/2000 | Rink | |
| 6,039,198 | A | 3/2000 | Wolfe | |
| 6,089,391 | A | 7/2000 | Abelbeck | |
| 6,105,468 | A | 8/2000 | Fohrman | |
| 6,598,757 | B2 | 7/2003 | Stillinger | |

(Continued)

FOREIGN PATENT DOCUMENTS

| | | | |
|---|---|---|---|
| WO | WO9716355 | A1 | 5/1997 |
| WO | WO0075034 | A1 | 12/2000 |

*Primary Examiner* — Andrew T Kirsch
(74) *Attorney, Agent, or Firm* — Alfred M. Walker

(57) ABSTRACT

A bottle seal breaker cap breaks a foil substrate seal on the top of the body of a medicine or supplement bottle. It has one or more notches, preferably a single notch, extending up from the bottom peripheral lip of a bottle cap, including a cutting surface deep enough to cut into a sealed foil substrate installed for sanitary reasons on top of the body of a medicine or supplement bottle.

11 Claims, 4 Drawing Sheets

(56) References Cited

U.S. PATENT DOCUMENTS

| | | | | |
|---|---|---|---|---|
| D519,843 | S | 5/2006 | Forte | |
| 7,175,043 | B2 | 2/2007 | O'Neal | |
| 7,410,071 | B1 | 8/2008 | Seib | |
| 8,079,485 | B2 * | 12/2011 | Berndt | B65D 51/22 215/212 |
| 8,616,090 | B2 | 12/2013 | Ferraro | |
| 8,844,406 | B2 | 9/2014 | Ferraro | |
| 2004/0111803 | A1 | 6/2004 | Mazur | |
| 2007/0181522 | A1 | 8/2007 | Davidson | |
| 2007/0205198 | A1 | 9/2007 | Huber | |
| 2008/0098604 | A1 | 5/2008 | Levi | |

* cited by examiner

ADAPTABLE BOTTLE SEAL BREAKER CAP

FIELD OF THE INVENTION

The present invention relates to medicine or supplement bottles with caps and sealed foil tops.

BACKGROUND OF THE INVENTION

Many food and pharmaceutical products and others are packaged in containers with screw-on caps having an adhesively attached tamper evident membrane over the opening. The seals may be aluminum foil, cardboard, or plastic membranes. Some seals have integral removal tabs which may be difficult to grasp especially by arthritis afflicted senior citizens. In any case, after the cap is initially unscrewed, the membrane must next be removed before the product can be used.

Often, consumers must resort to the use of improvised tools at hand such as knives, screwdrivers, or scissors to penetrate the membrane and either cut it or create a hole in it so that it can be torn and removed by hand. This creates an inconvenient and dangerous situation. Clearly, a safe convenient means for penetrating the membrane should be attached to or part of the screw cap.

The prior art reveals two US patents (U.S. Pat. Nos. 8,616,090 and 8,844,406) of Joseph Ferraro entitled Bottle Seal Breaker, which show four embodiments of membrane seal breakers which are part of the bottle caps. The present invention (also of Applicant Joseph Ferraro) is yet another embodiment which is an improvement over the prior art.

The first embodiment of the cited patents (U.S. Pat. Nos. 8,616,090 and 8,844,406 of Ferraro) illustrated in FIGS. 1-3 of Ferraro '090 and '406 has a straight notch on the bottom edge of the cap forming a short outer segment used for penetrating the membrane. While easy to manufacture and safe, it requires a bottle cap with enough bottom extension beyond the start of the threads to provide a notch deep enough for penetration without interfering with smooth thread operation.

The second embodiment of the cited patents (FIGS. 4 and 5 of Ferraro '090 and '406) shows a curved slot near the top surface of the cap on the side that is used for membrane penetration. Two aspects which add cost to the cap of this embodiment are the use of a more complex mold with a movable feature to form the side slot and the need for extra material thickness on the side of the cap to provide the required slot depth.

The third and fourth embodiments of the cited patents (FIGS. 6 and 7 of Ferraro '090 and '406) use pointed cap extensions to form membrane penetrating elements. The material of the extensions is a slight extra cost enhancer, while the pointed extensions are a hazard that may cause scratches in use.

The present invention overcomes all of these shortcomings.

OBJECTS OF THE INVENTION

An object of this invention is to provide a bottle seal breaker cap which is adaptable to a wide variety of bottle caps, easily manufactured, safe, and economical.

It is also an object of the present invention to provide a bottle seal breaker cap which is easy to use and safe to handle.

Other objects will become apparent from the following description of the present invention.

SUMMARY OF THE INVENTION

The present invention is a bottle seal breaker cap which is adaptable to a wide variety of bottle caps. It has one or more notches, preferably a single notch, extending up from the bottom peripheral lip of a bottle cap, including a cutting surface deep enough to cut into a sealed foil substrate installed for sanitary reasons on top of the body of a medicine or supplement bottle.

It is a notch in the form of a right triangle on the bottom edge of the bottle cap. The short vertical wall is angled to form a dull cutting edge while the longer sloping side is full material width. In fact, the notch can be molded in a simple mold as part of the cap. It adds no time nor extra material in the manufacturing phase. The notch is adaptable to a wide variety of caps needing neither height nor thickness enhancement for operation. It is safe in that it provides one rounded point at the bottom edge of the cap which is not a location of frequent finger contact. The notch fits in such a manner as to not impinge on the internal cap threads, and it even works on caps with multiple thread starts. The seal breaker of this invention is ergonomically designed for easy use; it is easy to align with the side of the membrane using the sloping edge as a guide. While the notch follows the circular bottom contour of the bottle cap, both the short vertical cutting edge and the longer sloping edge are seen as intersecting straight lines in a side elevation.

This invention is adaptable to bottle caps formed by injection molding using unscrewing molds, molds using collapsing cores, or molds using the bump-off method without secondary operations. The invention is also compatible with metal bottle caps, but secondary operations such as die cutting or grinding would be used to form the notch.

In alternate embodiments, the side elevations of the notch can show contours which deviate from straight lines. In fact, an infinite variety of contour shapes can be used. The cutting edge may be serrated. Concave arcuate contours of either the short cutting edge or the long sloping edge or both may be used to enhance the ergonomics or the aesthetics of the side notch. A single continuous contour can be used to form a notch. A notch formed as a shallow wide rectangular shape with a single pointed tooth in middle (as a single serration) can also be used. Other geometric shapes may be used as well, such as serrated edges, which are not shown For example, the notched cut may assume any infinitely variable geometric shape for a cap with a notched opening extending up from a bottom edge of the bottle cap, which performs the same function of breaking a foil seal on top of a medicine or supplement bottle.

BRIEF DESCRIPTION OF THE DRAWINGS

The present invention can best be understood in connection with the accompanying drawings. It is noted that the invention is not limited to the precise embodiments shown in drawings, in which:

FIG. 1 is a perspective view showing a container with a seal breaker cap of this invention screwed on;

DETAILED DESCRIPTION OF THE INVENTION

Figure 1:
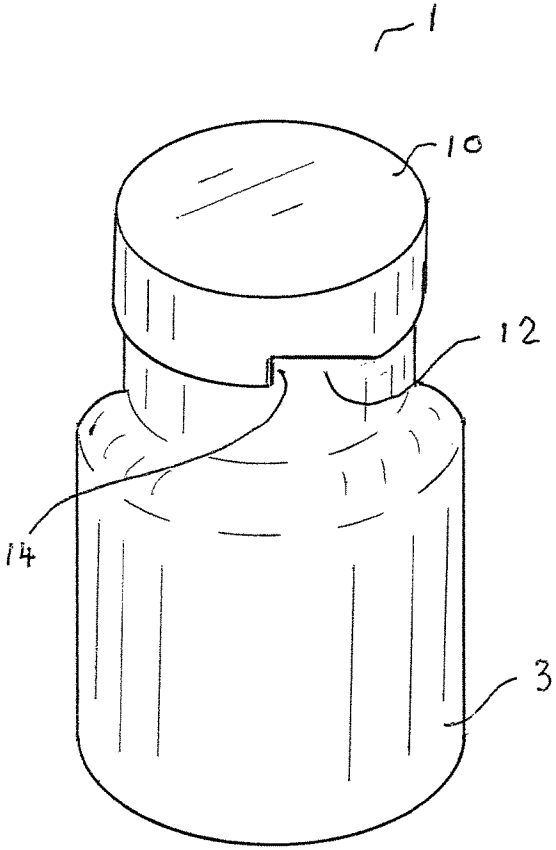

FIG. 1 shows a sealed bottle 1 with a bottle seal breaker cap 10 of this invention. Cap 10 is simply screwed onto bottle 3. The seal breaking feature is the notch formed by sloping side 12 and seal breaking short edge 14 which is angled to a dull cutting edge which can be formed by the cap mold with no secondary operations.

Figure 2:
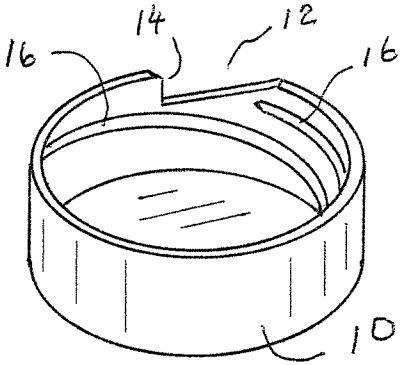
FIG. 2 is a perspective view of an inverted cap of this invention with a single thread showing the fit of the side notch.

FIG. 2 shows upside down the notch on cap 10 with a single start thread 16. Note the fitting of the notch in the cap whereby the sloping part 12 fits under the first thread spiral and the cutting edge 14 fits under the second thread spiral. Note that thread 16 is not impinged in any fashion.

Figure 3:
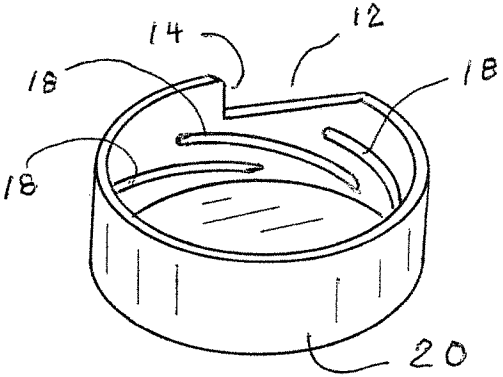
FIG. 3 is a perspective view of an inverted cap with four thread starts of this invention showing the fit of the side notch.

FIG. 3 shows upside down a seal breaker cap 20 having a four start thread 18. The features of the notch fit the same way as in the single start cap 10. This type of cap is common on juice or milk cartons which are sometimes membrane sealed.

Figure 5:
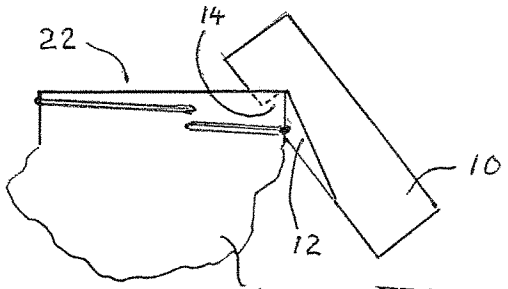
FIG. 5 is a side elevation detail of the corner of the notch penetrating the membrane in the relative orientation of FIG. 4.
Figure 4:
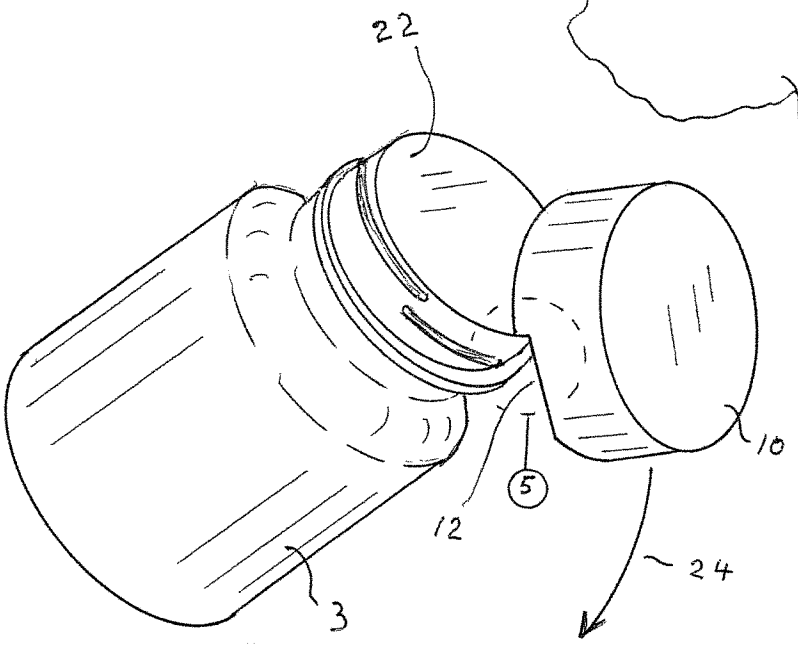
FIG. 4 is a perspective view of a bottle with top sealing membrane and a seal breaking cap of this invention in an orientation of penetrating the membrane. The bottle can be held in one hand while the cap is held in the other in the orientation shown.

The method of use for puncturing and then cutting a membrane is shown in FIGS. 4 and 5. Note membrane 22 is in place sealing the top opening of bottle 3. In FIG. 4, the cap has been removed and the end of notch line 14 (the cutting edge) has penetrated membrane 22 and will continue to cut it at the edge as cap 10 is moved along path 24 following the edge of the top opening of bottle 3. The penetration is better illustrated in the side elevation detail of FIG. 5 as the point at the end of notch side 14 is below the surface of membrane 22.

Figure 6:
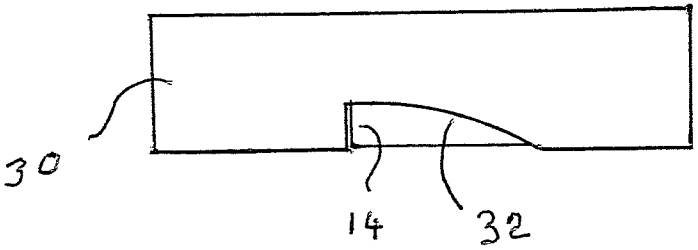
FIG. 6 is a side elevation showing a bottle cap of this invention showing a concave sloping notch edge.
Figure 7:
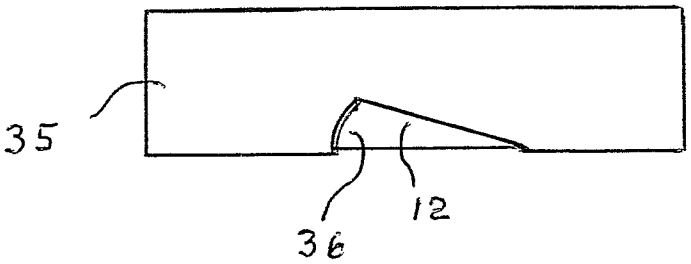
FIG. 7 is a side elevation of a notched bottle cap showing a concave beveled cutting edge; and, FIG. 8 is a side elevation of a notched bottle cap showing concave cutting edge as well as a concave sloping edge.
Figure 8:
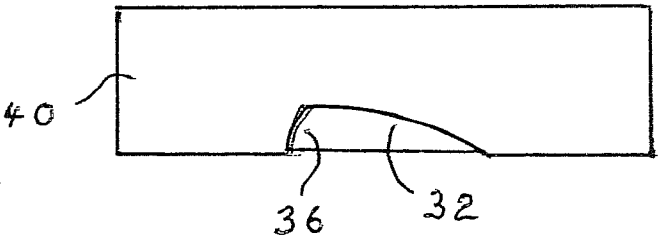
Figure 9:
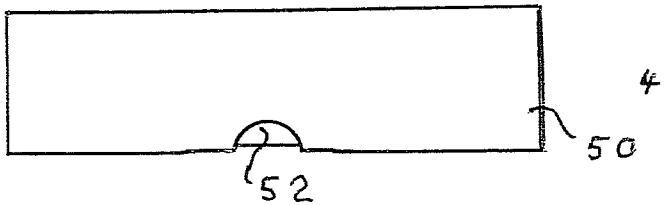
FIG. 9 is a side elevation of a notched bottle cap having a notch formed by a single continuous curve.

FIGS. 6-8 show alternate embodiments using concave arcuate line elements to form the membrane cutting notch on the bottle cap. FIG. 9 shows a notch formed by a single continuous curve. Note that all notches shown fit as shown in the inverted cap drawings of FIGS. 2 and 3 regardless of the contours; they do not impact the threads.

Bottle cap 30 in FIG. 6 uses the same straight cutting edge 14 as in FIGS. 1-5, but the sloping edge is now a concave arcuate shape 32. Bottle cap 35 in FIG. 7 shows a straight sloping side 12 as shown in FIGS. 1-5, but a tilted concave arcuate shape 36 is used for the beveled cutting edge. FIG. 8 shows bottle cap 40 with a notch having arcuate cutting edge 36 mated with arcuate sloping edge 32. FIG. 9 shows bottle cap 50 with a notch 52 formed by a continuous curve. Since this particular notch is symmetrical and either end can be used for cutting, it is equally convenient for both left and right-handed consumers to use.

Figure 10:
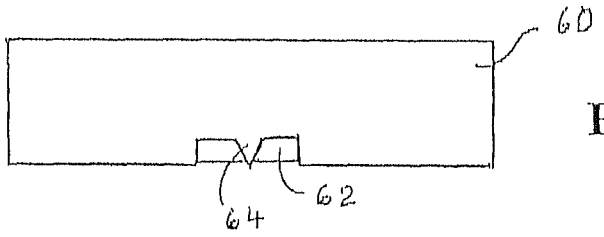
FIG. 10 is a side elevation of a notched bottle cap having a notch with a single pointed tooth serration.
Figure 11:
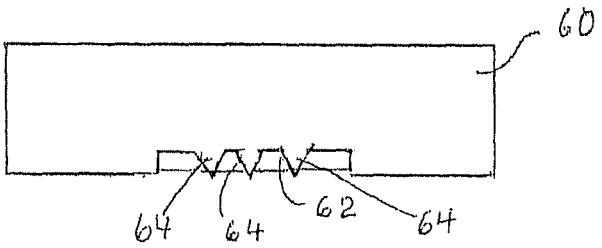
FIG. 11 is a side elevation of a notched bottle cap having a notch with a plurality of pointed teeth serrations.

Bottle cap 60 in FIG. 10 shows a side view with a notch 62 as a shallow rectangle with a single tooth 64 pointed downward (a serration) in the center of the notch. Tooth 64 is used to pierce and cut the sealing membrane 22. It is known that multiple teeth 64 can be provided in a serrated version of the seal breaker, as shown in FIG. 11.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A container seal breaker for a container having a cap over a seal extending over a top opening in the container, said seal breaker comprising:

said container cap having a top wall and an interior for closing said top opening of the container formed by a downwardly extending side wall having a lower free edge and an interior threaded spiral on an inner surface of said container cap for engaging reciprocal threads on an outer surface of an outer wall of said container surrounding said top opening;

said interior threaded spiral having a first thread spiral starting at a point of the interior of said cap spaced apart from said lower free edge of said cap, and a second thread spiral extending from said first thread spiral and also being spaced apart from said lower free edge of said cap;

said downwardly extending side wall of said cap having at least one notched slit capable of penetrating and removing said seal, said notched slit formed in and extending along a linear chord portion of said lower free edge;

said at least one notched slit comprising (a) a seal breaking edge extending from said lower free edge of said downwardly extending side wall of said container cap and said seal breaking edge further extending linearly and continuously upward from said lower free edge of said cap substantially at a right angle from said lower free edge of said cap in a linear and continuous substantially perpendicular direction towards said top wall, said seal breaking edge terminating partway through said side wall, and (b) a sloping member extending from a termination point of said seal breaking edge to said free edge of said downwardly extending side wall non-parallel with said tree edge;

said seal breaking edge and said sloping member forming lines meeting at a vertex located at a top of said notched slit;

said vertex of said at least one notched slit fitting in said cap whereby said vertex between said seal breaking edge and said sloping member is between said lower free edge of said cap and the first interior thread spiral, under the first thread spiral portion thereof, and said vertex between said seal breaking edge and said sloping member fits between said lower free edge of said cap and said second thread spiral portion, under the second thread spiral portion, whereby said threaded spiral is not impinged by said vertex of said at least one notched slit;

said at least one notched slit in said lower free edge adapted to allow said cap to slide down in said notched slit over a top edge of said outer wall surrounding said top opening of said container for said seal breaking edge to penetrate said seal; and whereby said cap is slidable along said outer wall surrounding said top opening of said container for said seal breaking edge to remove said seal.

2. The container seal breaker as in claim 1 wherein said sloping member is linear.

3. The container seal breaker as in claim 1 in which said seal breaking edge is angled.

4. The container seal breaker as in claim 1 wherein said sloping member is curvilinear.

5. A container seal breaker for a container having a cap over a seal extending over a top opening in the container, said seal breaker comprising:

said container cap having a top wall and an interior for closing said top opening of the container formed by a downwardly extending side wall having a lower free edge and an interior threaded spiral on an inner surface of said container cap for engaging reciprocal threads on an outer surface of an outer wall of said container surrounding said top opening;

said interior threaded spiral having a first thread spiral starting at a point of the interior of said cap spaced apart from said lower free edge of said cap, and a second thread spiral extending from said first thread spiral and also being spaced apart from said lower free edge of said cap;

said downwardly extending side wall of said cap having at least one notched slit capable of penetrating and removing said seal, said notched slit formed in and extending along a linear chord portion of said lower free edge;

said at least one notched slit comprising (a) a curved seal breaking edge extending from said lower free edge of said downwardly extending side wall of said container cap and said seal breaking edge further extending arcuately and continuously upward from said lower free edge of said cap in an arcuate and continuous substantially upward direction towards to said top wall, said seal breaking edge terminating partway through said side wall, and (b) a sloping member extending from a termination point of said seal breaking edge to said free edge of said downwardly extending side wall;

said seal breaking edge and said sloping member forming lines meeting at a vertex located at a top of said notched slit;

said vertex of said at least one notched slit fitting in said cap whereby said vertex between said seal breaking edge and said sloping member is between said lower free edge of said cap and the first interior thread spiral, under the first thread spiral portion thereof, and said vertex between said seal breaking edge and said sloping member fits between said lower free edge of said cap and said second thread spiral portion, under the second thread spiral portion, whereby said threaded spiral is not impinged by said vertex of said at least one notched slit;

said at least one notched slit in said lower free edge adapted to allow said cap to slide down in said notched slit over a top edge of said outer wall surrounding said top opening of said container for said seal breaking edge to penetrate said seal; and whereby said cap is slidable along said outer wall surrounding said top opening of said container for said seal breaking edge to remove said seal.

6. The container seal breaker as in claim 5 wherein said sloping member is arcuate.

7. The container seal breaker as in claim 5 wherein said sloping member is a single continuous curve.

8. The container seal breaker as in claim 5 wherein said sloping member is curvilinear and said seal breaking edge is a tilted concave arcuate shape.

9. The container seal breaker as in claim 5 wherein said sloping member is arcuate and said seal breaking edge is arcuate.

10. The container seal breaker as in claim 9 wherein said sloping member and said seal breaking edge are symmetrically arcuate.

11. The container seal breaker as in claim 5 wherein said sloping member is linear.

* * * * *